United States Patent [19]

Engel

[11] 4,141,668

[45] Feb. 27, 1979

[54] METHOD AND APPARATUS FOR ERECTING A BRIDGE STRUCTURE

[75] Inventor: David J. Engel, Houston, Tex.

[73] Assignee: Raymond International, Inc., Houston, Tex.

[21] Appl. No.: 796,723

[22] Filed: May 13, 1977

[51] Int. Cl.[2] ..... E02B 17/00

[52] U.S. Cl. ..... 405/202; 405/203; 405/204; 14/71.1

[58] Field of Search ..... 61/87, 88, 90, 91, 92, 61/93, 95, 94, 98; 182/141; 14/28, 71.1, 0.3, 0.4, 0.7

[56] References Cited

U.S. PATENT DOCUMENTS

| | | | |
|---|---|---|---|
| 3,511,057 | 5/1970 | Suter | 61/93 |
| 3,708,985 | 1/1973 | Pogonowski et al. | 61/95 |
| 3,875,998 | 4/1975 | Charpentier | 166/0.5 |

FOREIGN PATENT DOCUMENTS

| | | | |
|---|---|---|---|
| 404697 | 4/1974 | U.S.S.R. | 61/87 |

*Primary Examiner*—Jacob Shapiro
*Attorney, Agent, or Firm*—Arnold, White & Durkee

[57] ABSTRACT

An apparatus for erecting a bridge structure which is adapted to be disposed above a body of water includes an elongated bridge member and a support tower pivotably mounted upon the bridge member. The support tower includes a caisson which has a jacking member telescopically mounted therein at its upper end and the support tower is further provided with a plurality of pile sleeves mounted upon its lower end, such that the support tower may be anchored to the surface underlying the body of water. The bridge structure has a gas flare line and a gas flare tip associated therewith.

A method for erecting a bridge structure above a body of water includes the steps of transporting a prefabricated bridge structure to a location adjacent an existing structure, pivoting a support tower associated with the bridge structure until it is substantially perpendicular to the longitudinal axis of the bridge structure, connecting one end of the bridge structure to the existing structure while the support tower is still in a spaced relationship with respect to the surface underlying the body of water, extending the support tower until it is in contact with the surface underlying the body of water, and then anchoring the support tower to the underwater surface. A gas flare line and gas flare tip is installed on the bridge structure.

32 Claims, 6 Drawing Figures

METHOD AND APPARATUS FOR ERECTING A BRIDGE STRUCTURE

BACKGROUND OF THE INVENTION

1. Field of the Invention

The invention relates to a method and apparatus for erecting a bridge structure and a bridge structure suitable for use above a body of water, wherein the bridge structure is connected to an existing structure and a gas flare line and gas flare tip is associated with the bridge structure. The gas flare line and gas flare tip is utilized for burning, or flaring, excess natural gas produced at an offshore oil well platform.

2. Description of the Prior Art

In offshore oil drilling and/or producing operations, excess amounts of natural gas are produced as a result of these operations. Frequently, this excess gas is disposed of by flaring, or burning it. For safety reasons, the flaring operation must be conducted at a remote location from the offshore platform, since the resultant heat given off by the flaring operation could cause a fire hazard and/or damage the offshore platform and its personnel.

Accordingly, many different apparatus have been proposed to enable the flaring operation to be conducted at a location remote from the platform. One type of apparatus utilized in conjunction with offshore platforms for flaring excess gas is exemplified in U.S. Pat. No. 2,894,269, issued July 14, 1959, to R. J. Dodge; U.S. Pat. No. 3,666,395, issued May 30, 1972, to J. W. Kubasta; and U.S. Pat. No. 3,902,843, issued Sept. 2, 1975, to M. Genini et al. This type of apparatus utilizes a submerged pipeline for transporting the gas from the offshore platform to a flare structure which is anchored to the underwater surface. The gas flare apparatus in the foregoing patents has some type of flexible connection between the gas flare and the lowermost portion of the device in contact with the underwater surface, whereby the gas flare is subject to movement caused by wave action and ocean currents.

Many problems are encountered in using the foregoing type of apparatus in deep-water offshore installations. Since the pipeline is submerged, there are many inherent problems relating to maintenance and construction of that pipeline. For example, were the pipeline to develop any leaks, the use of divers would be necessary to repair the pipeline. Accordingly, the cost of such repairs could be quite expensive, in addition to the difficulty in initially determining whether or not the submerged pipeline has any leaks. Furthermore, a submerged pipeline is subjected to excessive forces caused by water pressure, wave action, and/or ocean currents, whereby the pipeline must be constructed to withstand such forces. Such construction may substantially increase the cost of the flare installation. Furthermore, since the gas flare apparatus is capable of movement, the pipeline may be subjected to tensional forces as the gas flare moves away from the offshore platform, thus pulling the pipeline outwardly from the platform. This problem is believed to be particularly troublesome with respect to the apparatus of the Kubasta patent and could readily cause damage to the submerged pipeline.

Another approach has been suggested wherein a gas flare line and glas flare tip is supported from a cantilevered structure attached to the offshore platform. An example of this approach is found in U.S. Pat. No. 3,807,932, issued Apr. 30, 1974, to J. J. Dewald. The structure disclosed in this patent is utilized to support an apparatus for burning, or flaring, excess oil produced in the course of drilling and/or testing offshore oil wells. The disadvantages of this approach are numerous.

If a large volume of excess gas is to be flared, the heat generated by the flaring operation requires that the flare tip be disposed quite a great distance from the offshore platform in order to avoid damage to the platform and/or personnel working thereon. Some installations presently in use require the flare tip to be located approximately 400 feet from the offshore platform. As is readily apparent, the construction of a cantilevered support for a gas flare line and gas flare tip having such a great length presents many problems. In addition to the great expense involved, constructing such a support under potentially adverse weather conditions prevalent at deep-water offshore locations could present many problems in installing such a cantilever support. For example, the patent of Dewald suggests that the cantilevered support is swung into place by a crane, or similar device, whereupon the cantilevered support is then aligned with a support disposed on the offshore platform and the cantilevered support is then pinned to the offshore platform. Such a procedure would be extremely difficult when attempting to mount a cantilevered support with a length approximating 400 feet, since aligning the cantilevered support such that it could be pinned to the offshore platform would be extremely difficult under the weather conditions prevalent at many deep-water offshore platform locations. For example, were the cantilevered support to be lifted by a crane disposed upon the offshore platform, great difficulty and expense would be encountered in attempting to align the cantilevered support with its mounting bracket disposed on the offshore platform due to the fact that the center of gravity of the cantilevered support would be located approximately 200 feet from the offshore platform. In order to adequately balance the cantilevered support such that the support would not tilt toward the ocean, the boom of a crane located upon the offshore platform would have to have a length in excess of 200 feet. If the crane were to be disposed upon a barge located at a location remote from the offshore platform, the crane would be subject to the slightest movement caused by wave or wind action upon the barge, whereby it would be extremely difficult to align the cantilevered support to its mounting brackets disposed upon the offshore platform.

Another problem which could result when utilizing a cantilevered support for the gas flare line and gas flare tip could result from the fact that all the forces exerted upon the cantilevered support are borne by its mounting bracket disposed on the offshore platform. High wind and heavy sea conditions acting upon the end of a cantilevered support of a substantial length could result in the mounting bracket being torn loose from the offshore platform, since the end of the cantilevered support, which is remotely disposed from the offshore platform, does not have any support beneath it for providing additional stabilization to the cantilevered support.

Accordingly, prior to the development of the present invention, there has been no method and apparatus for erecting a bridge structure suitable for use above a body of water which is economical to use and erect, easily erected in deep-water offshore locations, and can withstand the adverse weather conditions prevalent in such locations. Therefore, the art has sought a method and apparatus for erecting a bridge structure and a bridge structure suitable for use above a body of water which provides an easily erected, economical bridge structure capable of being erected at a deep-water offshore locations and withstanding the potentially adverse weather conditions prevalent at such locations, absent the problems of previously proposed bridge structures.

SUMMARY OF THE INVENTION

In accordance with the invention, the foregoing has been achieved by the present method and apparatus for erecting a bridge structure and a bridge structure suitable for use above a body of water, wherein the bridge structure is connected to an existing structure and a gas flare line and gas flare tip associated with the bridge structure.

The present invention includes a method for erecting a bridge structure above a body of water wherein a prefabricated bridge structure is transported to a location adjacent an existing structure. The prefabricated bridge structure includes an elongated horizontal bridge member having at least one extensible support tower pivotably mounted upon said bridge member at a location intermediate the ends of the bridge member. The support tower is initially disposed in a plane substantially parallel to the longitudinal axis of the bridge member. The support tower is then pivoted until it is substantially perpendicular to the longitudinal axis of the bridge member and disposed in a spaced relationship with respect to the surface underlying the body of water. Thereupon, one end of the bridge member is connected to the existing structure while the support tower is still in a spaced relationship with respect to the surface underlying the body of water. The support tower is then extended until it is in contact with the surface underlying the body of water. Finally, the support tower is anchored to the surface underlying the body of water.

In one embodiment of the present invention the support tower is anchored to the surface underlying the body of water by driving piles into that surface and securing the support tower to the piles. The support tower may be extended until the bridge structure is at least substantially parallel with a plane formed by the upper surface of the existing structure. The support tower is then further extended until the end of the bridge structure, which is connected to the existing structure, is disposed lower than the other end of the bridge structure.

As indicated above, in more specific terms, the support tower includes a caisson having a jacking member telescopically mounted within the caisson at its upper end, and the jacking member is secured within the caisson after the bridge structure is at least substantially parallel with the plane formed by the upper surface of the existing structure. A gas flare line and gas flare tip is installed on the bridge structure. Alternatively, the bridge structure may include a prefabricated gas flare line and a gas flare tip is attached to the gas flare line after the support tower is anchored to the surface underlying the body of water. The support tower is pivoted by flooding the interior of the support tower.

The present invention further includes an apparatus for erecting a bridge structure adapted to be disposed above a body of water which includes an elongated bridge member having means for connecting one of the ends of the bridge member to an existing structure. At least one support tower is pivotably mounted upon the bridge member at a location intermediate the ends of the bridge member and is adapted to be pivoted to a substantially perpendicular relationship with respect to the bridge member. The support tower includes a caisson having a jacking member telescopically mounted therein at its upper end and a jacking means for extending the jacking member outwardly from the caisson. The support tower is provided with a means for anchoring it to the surface underlying the body of water.

As indicated above, in more specific terms, the apparatus of the present invention may include a gas flare line disposed upon the bridge member, and the gas flare tip is attached to the gas flare line. The means for anchoring the support tower may comprise an anchoring skirt, which has a larger cross-sectional area than that of the caisson, and is fixedly secured to the lower end of the caisson, and a plurality of pile sleeves mounted upon the lower end of the support tower which extend through the anchoring skirt.

In another aspect of the apparatus of the present invention, the bridge member may include means for installing a gas flare line, and this means may comprise a plurality of rollers disposed upon said bridge member.

In another aspect of the apparatus of the present invention, the jacking means may comprise a slip-type jack disposed within the caisson, and the jacking member is disposed within the jack. The jacking member may be further disposed within a sleeve located within the caisson and the jacking member is adapted to be secured within the sleeve to the caisson, as by grouting the jacking member within the sleeve.

The bridge member may be provided with releasable flotation tanks adapted to support the bridge member upon the body of water while it is being transported to a desired location, and the caisson may be provided with valves adapted to be opened to flood the interior of the caisson to allow the support tower to pivot into a substantially perpendicular relationship with respect to the bridge member.

The present invention also includes a bridge structure which is disposed above a body of water and is adapted to be connected to an existing structure which includes an elongated bridge member which has means for connecting one of the ends of the bridge member to the existing structure. The bridge structure further includes at least one support tower mounted beneath and substantially perpendicular to the bridge member at a location intermediate the ends of the bridge member. The support tower includes a caisson with a jacking member, having upper and lower portions, telescopically mounted within the caisson at its upper end. The jacking member has its upper portion connected to the bridge member and its lower portion secured within a sleeve disposed within the caisson. A jacking means is associated with the caisson and is adapted to extend the jacking member outwardly from the caisson, a portion of the jacking member being engaged by the jacking means. Anchoring means are provided for anchoring the support tower to the surface underlying the body of water.

In another aspect of the bridge structure of the present invention, the bridge structure includes a gas flare line associated with the bridge member, and a gas flare tip is connected to the gas flare line.

The method and apparatus for erecting a bridge structure and the bridge structure of the present invention, when compared with previously proposed prior art methods, apparatus, and structures, have the advantages of being easily constructed, economical to erect, and capable of withstanding adverse weather conditions prevalent in deep-water offshore locations.

While the invention will be described in connection with the preferred embodiment, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 1:
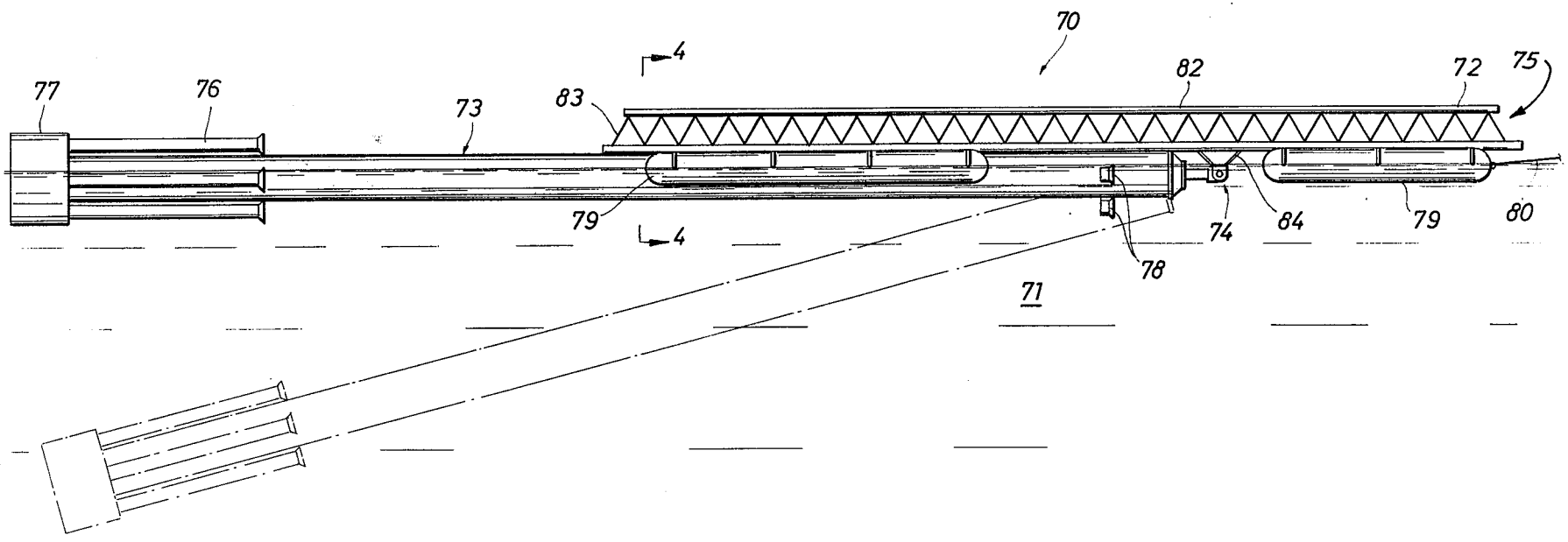
FIG. 1 is a front elevation of an apparatus for erecting a bridge structure in accordance with the present invention.
Figure 2:
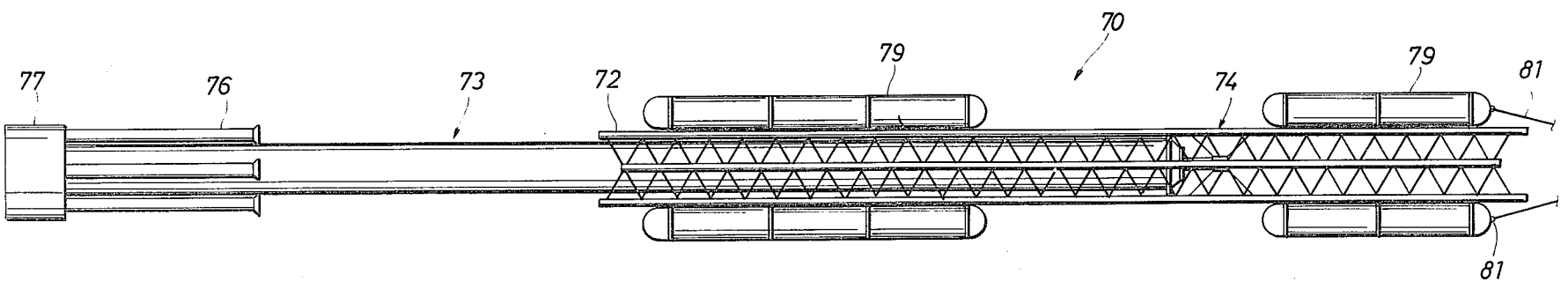
FIG. 2 is a top view of the apparatus of FIG. 1.

Referring now to FIGS. 1 and 2, an apparatus 70 for erecting a bridge structure adapted to be disposed above a body of water 71 in accordance with the present invention is shown. Apparatus 70 includes an elongated bridge member 72 and a support tower 73 pivotably mounted upon the bridge member 72 by means of a pivotal connection 74. Preferably, pivotal connection 74 is disposed beneath the elongated bridge member 72 and intermediate the ends of bridge member 72. It should be readily apparent that pivotal connection 74 could be disposed anywhere intermediate the ends of bridge member 72, including being disposed directly beneath the end 75 of bridge member 72 whereat a gas flare tip, to be hereinafter described, is intended to be located.

Still referring to FIGS. 1 and 2, it is seen that support tower 73 has an anchoring means, or a plurality of pile sleeves 76 and an anchoring skirt 77, fixedly secured to the lower end of support tower 73. Support tower 73 further includes a plurality of pile guides 78 mounted about the circumferences of support tower 73. The function of pile sleeve 76, anchoring skirt 77, and pile guides 78 will be hereinafter described in more detail in reference to FIG. 5. Preferably, anchoring skirt 77 has a larger cross-sectional area than support tower 73. However, the use of anchoring skirt 77 is optional dependent upon what type of surface underlies body of water 71.

Elongated bridge member 72 and support tower 73 are intended to be towed upon a body of water 71 to an offshore location adjacent an existing structure to be hereinafter described. To this end, elongated bridge member 72 may be provided with releasable auxiliary flotation tanks 79. The prefabricated bridge structure, or elongated bridge member 72 and extensible support tower 73, includes some means for attaching a tow line 80 to a conventional ship (not shown). Preferably, tow line 80 is attached to the forward ends of two of the releasable flotation tanks 79, as shown at 81.

Figures 3, 4:
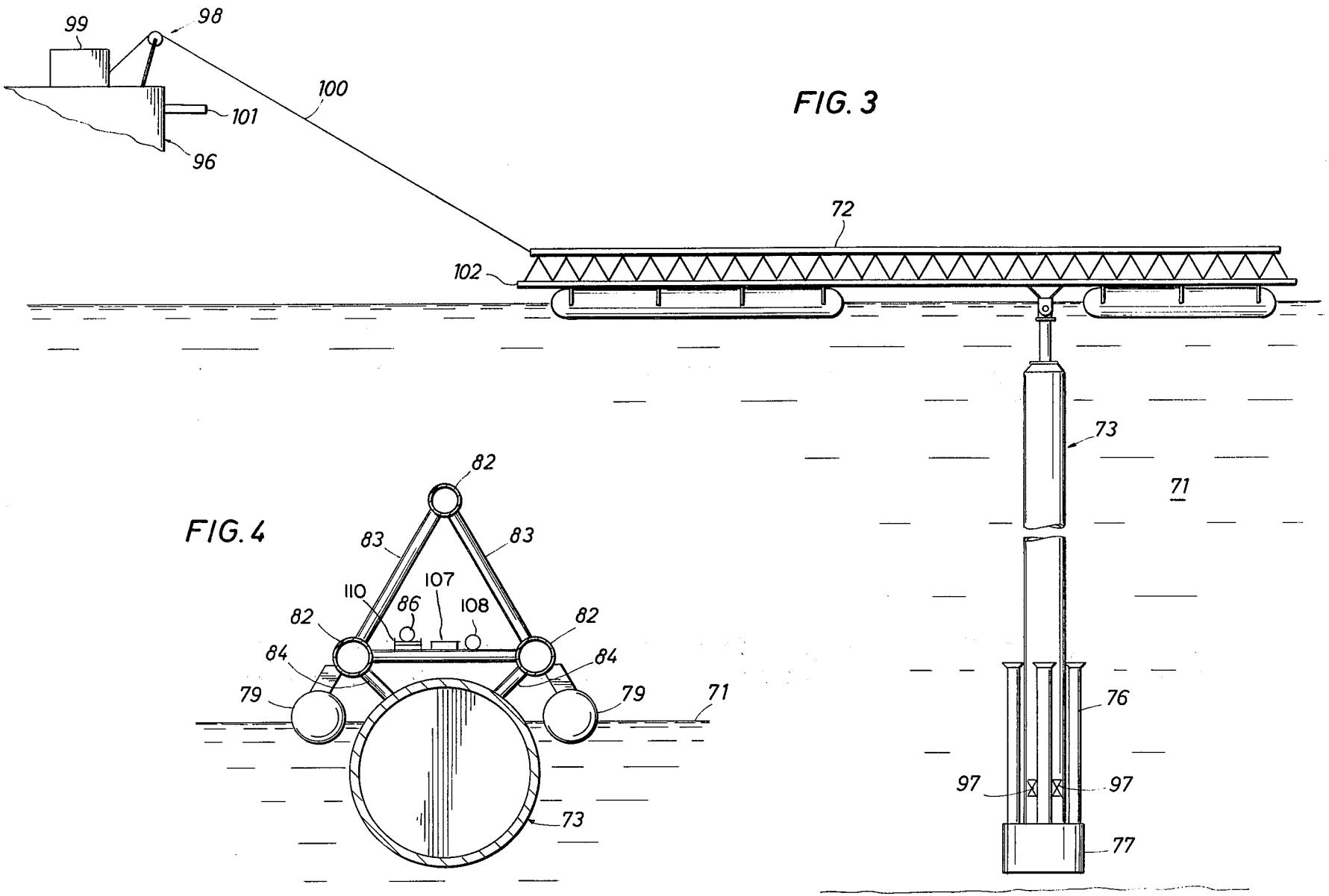
FIG. 3 is a front view of an apparatus for erecting a bridge structure and illustrates a method for erecting a bridge structure in accordance with the present invention.
FIG. 4 is a cross-sectional view taken along line 4—4 of FIG. 1.

Turning now to FIG. 4, the details of the construction of elongated bridge member 72 will be described. Elongated bridge member 72 is preferably constructed of a plurality of tubular members 82, which are interconnected by a plurality of struts 83. Tubular members 82 and struts 83 are likewise shown in FIG. 1. Tubular members 82 and struts 83 may be manufactured from any suitable material, such as steel, and are large enough to withstand the forces exerted by the waves encountered during the ocean towing operation. By sealing the ends of tubular members 82 and struts 83, the elongated bridge member 72 is at least partially buoyant, whereby the additional releasable auxiliary flotation tanks 79 supply any additional buoyancy required to keep the elongated bridge member 72 afloat during the towing operation.

Figures 5, 6:
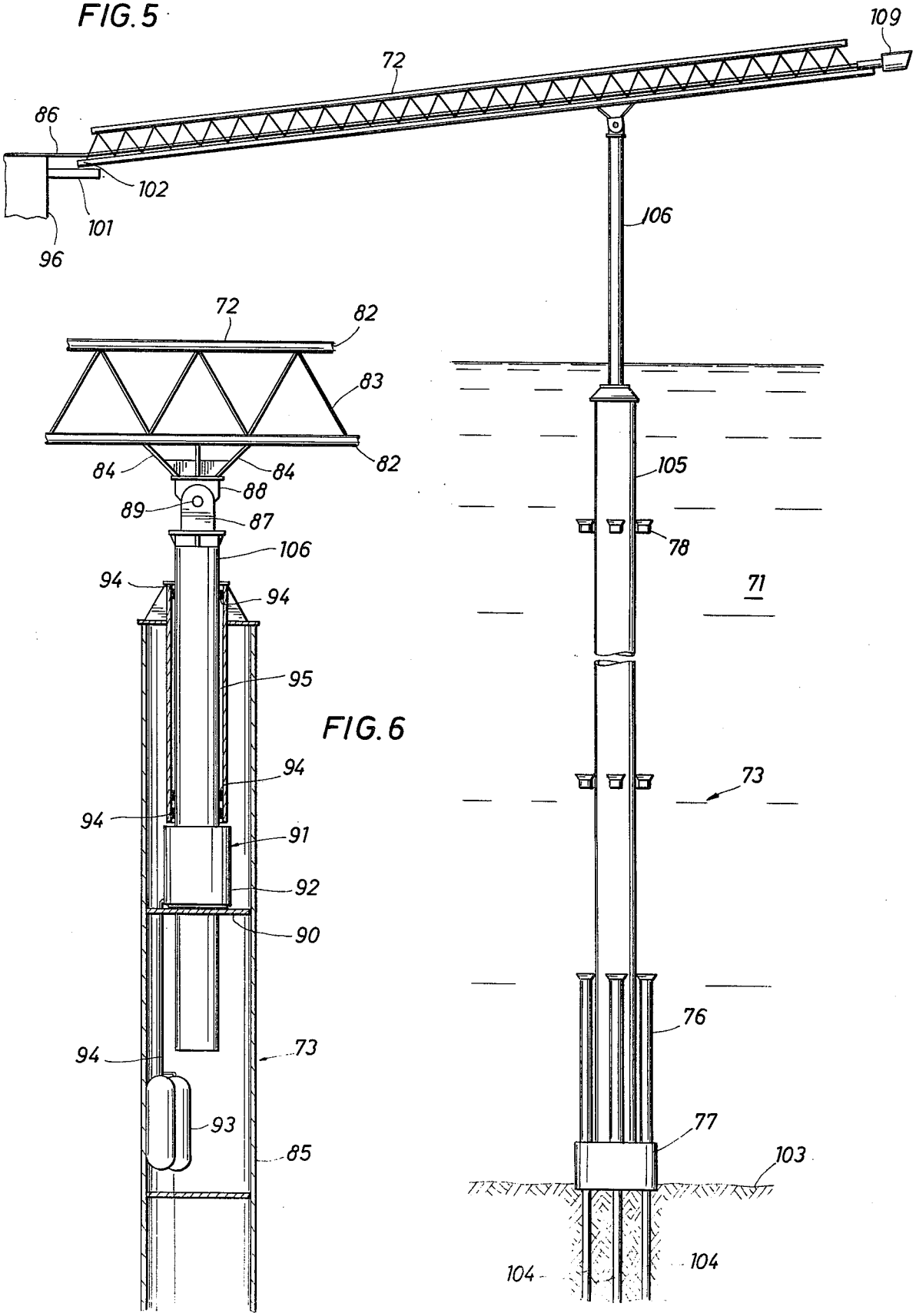
FIG. 5 is a front view of a bridge structure in accordance with the present invention.
FIG. 6 is a partial cross-sectional view of a portion of the apparatus shown in FIG. 3 in accordance with the present invention.

Still referring to FIG. 4, it can be seen that a plurality of struts 84 are disposed beneath bridge member 72, and as best seen in FIGS. 1 and 6, struts 84 support pivotal connection 74, which is located intermediate the ends of bridge member 72. Disposed along the longitudinal axis of bridge member 72 is a walkway 107, which is supported by a plurality of struts 83. A gas flare line 86 and a vent line 108 may be suitably secured to bridge member 72 adjacent walkway 107, gas flare line 86 to be hereinafter described in more detail.

Still referring to FIGS. 1 and 4, it can be seen that support tower 73 is initially disposed in a plane substantially parallel to the longitudinal axis of bridge member 72 while the prefabricated bridge structure, or elongated bridge member 72 and support tower 73, is being transported above the body of water 71.

Turning now to FIG. 6, the construction of support tower 73 and pivotal connection 74 will be described. Extensible support tower 73 includes a cylindrical caisson 85 which has a cylindrical jacking member 106 telescopically mounted within the upper end of caisson 85. Jacking member 106 has a smaller diameter than caisson 85 and is concentrically mounted within the upper end of caisson 85. It should be readily apparent that although a cylindrical configuration is shown for caisson 85 and jacking member 106, any suitable cross-sectional configuration could be utilized; e.g., a square, hexagonal, octagonal, etc. cross-sectional configuration. Pivotal connection 74 includes a bracket 87 fixedly secured to the top of jacking member 106, a mating bracket 88 suspended beneath bridge member 72 by means of struts 84, and a suitable pin 89 which passes through a conventional bushing (not shown) in brackets 87 and 88, whereby support tower 73 is adapted to be pivoted to a substantially perpendicular relationship with respect to bridge member 72. It should be pointed out that while bridge member 72 and support tower 73 are being towed offshore in the configuration shown in FIGS. 1 and 2, wherein the longitudinal axis of support tower 73 is substantially parallel to the longitudinal axis of bridge member 72, bridge member 72 and support tower 73 are connected via pivotal connection 74 and one or more temporary connections (not shown), such as chains, ropes, etc.

Still referring to FIG. 6, it is seen that the interior space of caisson 85 is provided with a mounting plate 90 which is disposed in a plane substantially perpendicular to the longitudinal axis of caisson 85 and is disposed toward the upper end of caisson 85. Disposed upon mounting plate 90 is a jacking means 91 which is preferably a slip-type jack 92. The pistons (not shown) of jack 92 are preferably gas operated, whereby a plurality of nitrogen gas bottles 93 are mounted within caisson 85 and a feedline 94 is associated with the bottles 93 and jack 92 for supplying the nitrogen gas to jack 92. Although any suitable jacking means may be utilized, the use of a slip-type jack as disclosed in U.S. Pat. No. 3,876,181, issued Apr. 8, 1975, to J. E. Lucas, is preferred. Jacking member 106 is concentrically mounted within jack 92 and additionally passes through an opening in mounting plate 90. A plurality of conventional packers 94 are disposed within a grout sleeve 95 which is concentrically disposed within the upper portion of caisson 85. The packers 94 and grout sleeve 95 concentrically surround the upper portion of jacking member 86. After jacking member 106 has been extended outwardly to its final position, as to be hereinafter described, packers 94 are set into position and grout sleeve 95 is filled with a suitable grouting mixture, capable of setting into a hardened state in an underwater location, whereby jacking member 106 is permanently grouted within caisson 85.

Support tower 78 may be constructed such that the interior of caisson 85 is air tight. Thus, support tower 73 will be partially buoyant to further facilitate the transporting of the prefabricated bridge structure to its offshore location. Preferably, the combined length of caisson 85 and anchoring skirt 77 approximates, or is slightly less than, the depth of water 71 at the installation location.

Turning now to FIGS. 1 and 3, the method of the present invention will be set forth. As previously described, the prefabricated bridge structure, or elongated bridge member 72 and extensible support tower 73, are intended to be towed upon a body of water 71 to an offshore location. During the towing operation, the longitudinal axis of support tower 73 is substantially parallel to the longitudinal axis of elongated bridge member 72 as previously described. After the prefabricated bridge structure has been transported to its intended location adjacent an existing structure 96, support tower 73 is pivoted about pivotal connection 74 as shown in phantom lines in FIG. 1. The pivoting is accomplished by releasing the temporary connections, (not shown) and flooding the interior of caisson 85 by means of suitable flood valves 97. The interior of caisson 85 is preferably flooded sequentially beginning with the bottom of caisson 85. The top of the support tower 73 is held slightly below the top of the body of water 71 by pivotal connection 74 and the buoyancy of bridge member 72.

Structure 96, as shown in FIG. 3, for purposes of illustration comprises an offshore production platform. It should be readily apparent that existing structure 96 could also be an existing pier or a land formation adjacent a body of water. For such structures 96 the method and apparatus of the present invention could be utilized to provide either an extension to an existing pier, or a bridge structure between two land formations disposed on either side of a body of water.

In the preferred embodiment, existing structure 96, an offshore production platform, is provided with a conventional hoisting apparatus 98 which includes a power winch 99 which applies a lifting force to elongated bridge member 72 via hoisting line 100. Platform 96 is also provided with a semi-circular bridge support 101 for mating with one of the ends of bridge member 72. One end of bridge member 72 is provided with a means for connecting 102 one of the ends of bridge member 72 to the semi-circular bridge support 101. The connecting means 102 may be a number of connection means; e.g., hooks, pin connections, thrust bearings, or a plate structure which can be welded to bridge support 101.

Referring now to FIGS. 3 and 6, the support tower 73 is shown after having pivoted until it is substantially perpendicular to the longitudinal axis of bridge member 72. After support tower 73 is in the position, jack 92 is activated whereby jacking member 106 is jacked out of caisson 85 until anchoring skirt 77, disposed at the lower end of support tower 73, is in a spaced relationship with respect to the surface 103 underlying body of water 71. Preferably, jack 92 is activated until anchoring skirt 77 just barely clears surface 103.

Hoisting line 100 is then passed from structure 96 to one end of bridge member 72 to connect them, and bridge member 72 and support tower 73 are winched toward structure 96. Bridge member 72 and support tower 73 are winched toward structure 96 until connecting means 102 is disposed substantially beneath bridge support 101. A work boat (not shown) may assist winch 99 in pulling bridge member 72 and support tower 73 toward structure 96. Additionally, the work boat will serve to insure that bridge member 72 is properly aligned with bridge support 101, whereby the longitudinal axis of bridge member 72 will be substantially parallel with the longitudinal axis of bridge support 101. The support 101 and bridge member 72 do not have to be precisely angularly aligned since bridge support 101 is semi-circular in configuration and can therefore accomodate a slight angular displacement of bridge member 72.

After bridge member 72 is properly aligned with bridge support 101, jack 92 is activated to thrust support member 73 into surface 103 underlying body of water 71. Anchoring skirt 77, which may have a beveled surface (not shown) at its lower end will serve to provide additional anchorage capability to jack 92 when support tower 73 is thrust into surface 103, particularly when surface 103 is a hard surface such as a rock formation. The end of bridge member 72 having connection means 102 is then hoisted by winch 99 until it is disposed above bridge support 101. Jack 92 is then activated to raise bridge member 72 out of water 71 whereby connection means 102 rests upon bridge support 101. After checking the positioning of bridge member 72 to insure that it is correctly disposed upon bridge support 101, support tower 73 is anchored to surface 103 underlying body of water 71.

Turning now to FIG. 5, support tower 73 is shown after having been anchored to surface 103 by a plurality of piles 104. Piles 104 may be driven using any conventional means for driving piles; e.g., a derrick barge (not shown) may be utilized for driving piles 104. After piles 104 have been driven through pile sleeves 76 and anchoring skirt 77, piles 104 are secured within the pile sleeves 76 in any conventional manner, such as by grouting in order to provide a stable foundation for support tower 73.

After the foundation operation has been completed, bridge 72 is then lifted by jack 92 and jacking member 106 to its final elevation as shown in FIG. 5. Jacking member 106 is extended until bridge member 72 is at least substantially parallel with a plane formed by the upper surface of the existing structure 96. Preferably, jacking member 106 is extended until the end of the bridge member 72 which is connected to the existing structure 96 via connection means 102, is disposed lower than the other end of bridge member 72 as shown in FIG. 5. After the correct height has been reached, jacking member 106 is permanently secured within the sleeve 95 as described previously. Of course, jacking member 106 may be secured within sleeve 95 by other means, such as by welding, etc.

Alternatively, after bridge member 72 is properly aligned with bridge support 101 and while anchoring skirt 77 is still in a spaced relationship with surface 103, winch 99 may be activated to retract hoisting line 100 whereby one end of bridge member 72 is raised until connection means 102 is disposed upon support 101. Connection means 102 may be suitably affixed to support 101 or may be flexibly connected to support 101 via hoisting line 100. Jack 92 is then activated to thrust support member 73 into surface 103 and to raise bridge member 72 out of water 71, whereupon support tower 73 is anchored to surface 103 and jacking member 106 is grouted within grout sleeve 95 as previously described.

Gas flare line 86 and gas flare tip 109 are then installed on bridge member 72. Gas flare line 86 and gas flare tip 106 may be installed by utilizing a prefabricated gas flare line 86 which is included as a part of bridge member 72 at the time the apparatus 70 for erecting a bridge structure are fabricated at a suitable shipyard. Thus, the prefabricated gas flare line 86 is suitably connected to a section of gas flare line 86 on platform 96 and gas flare tip 109 is attached to one end of the gas flare line 86 as shown in FIG. 5. Alternatively, bridge member 72 may be provided with means for installing gas flare line 86, wherein the means for installing the gas flare line includes a plurality of rollers 110 (FIG. 4) disposed upon and along the length of bridge member 72. These rollers could be disposed adjacent walkway 107, whereby a gas flare line 86 could be pulled from platform 96 onto and along bridge member 72 until it extends beyond the end of bridge member 72, whereupon gas flare tip 109 may be attached.

The foregoing description of the invention has been directed in primary part to a particular preferred embodiment in accordance with the requirements of the Patent Statutes and for purposes of explanation and illustration. It will be apparent, however, to those skilled in this art, that many modifications and changes in the specific apparatus utilized may be made without departing from the scope and spirit of the invention. For example, two or more identical support towers 73 could be pivotably mounted upon bridge member 72, whereby the length of bridge member 72 could be increased and bridge member 72 would be provided with additional stability.

It is applicant's intention in the following claims to cover such modifications and variations as fall within the true spirit and scope of the invention.

What is claimed is:

1. A method for erecting a bridge structure above a body of water comprising the steps of:

transporting a prefabricated bridge structure to a location adjacent an existing structure, said prefabricated bridge structure including an elongated horizontal bridge member having at least one extensible support tower pivotably mounted upon said bridge member at a location intermediate the ends of said bridge member, said support tower being initially disposed in a plane substantially parallel to the longitudinal axis of said bridge member;

pivoting said support tower until it is substantially perpendicular to the longitudinal axis of said bridge member and in a spaced relationship with respect to a surface underlying said body of water;

connecting one end of said bridge member to said existing structure while the support tower is still in a spaced relationship with respect to the surface underlying said body of water;

extending the support tower until it is in contact with the surface underlying said body of water; and anchoring the support tower to the surface underlying said body of water.

2. The method of claim 1 wherein the support tower is anchored to the surface underlying said body of water by driving piles into said surface and securing the support tower to said piles.

3. The method of claim 2 which further includes the step of extending the support tower until the bridge structure is at least substantially parallel with a plane formed by the upper surface of the existing structure.

4. The method of claim 3 wherein the support tower is further extended until the end of the bridge structure, which is connected to the existing structure, is disposed lower than the other end of the bridge structure.

5. The method of claim 3 wherein said support tower includes a caisson having a jacking member telescopically mounted therein at its upper end, and said jacking member is secured within said caisson after the bridge structure is at least substantially parallel with a plane formed by the upper surface of the existing structure.

6. The method of claim 5 wherein said jacking member is secured within said caisson by grouting.

7. The method of claim 1 wherein a gas flare line and gas flare tip is installed on said bridge structure.

8. The method of claim 1 wherein said bridge structure includes a prefabricated gas flare line and a gas flare tip attached to said gas flare line after the support tower is anchored to the surface underlying said body of water.

9. The method of claim 1 wherein said support tower is pivoted by flooding the interior of said support tower.

10. An apparatus for erecting a bridge structure adapted to be disposed above a body of water comprising:

an elongated bridge member which includes means for connecting one of the ends of the bridge member to an existing structure; and at least one support tower pivotably mounted upon said bridge member and adapted to be pivoted to a substantially perpendicular relationship with respect to said bridge member, said support tower including a caisson having a jacking member telescopically mounted therein at its upper end, a jacking means for extending the jacking member outwardly from said caisson, and means for anchoring the lower end of said support tower to a surface underlying said body of water, said means for anchoring being fixedly secured to the lower end of said support tower, whereby relative motion between the support tower and the surface underlying said body of water is prevented.

11. The apparatus of claim 10 wherein a gas flare line is disposed upon said bridge member and a gas flare tip is attached to said gas flare line.

12. The apparatus of claim 10 wherein said bridge member includes means for installing a gas flare line.

13. The apparatus of claim 12 wherein said means for installing comprises a plurality of rollers disposed upon said bridge member.

14. The apparatus of claim 10 wherein said jacking means comprises a slip-type jack disposed within said caisson and said jacking member is disposed within said jack.

15. The apparatus of claim 10 wherein said jacking member is disposed within a sleeve located within the caisson and the jacking member is adapted to be secured within said sleeve to the caisson.

16. The apparatus of claim 10 wherein said bridge member is provided with releasable flotation tanks adapted to support said bridge member upon said body of water while it is being transported to a desired location, and said caisson is provided with valves adapted to be opened to flood the interior of said caisson to allow said support tower to pivot into a substantially perpendicular relationship with respect to said bridge member.

17. The apparatus of claim 10 wherein said anchoring means comprises an anchoring skirt, having a larger cross sectional area than said caisson, fixedly secured to the lower end of said caisson, and a plurality of pile sleeves mounted upon the lower end of the support tower and extending through said anchoring skirt.

18. A bridge structure disposed above a body of water and adapted to be connected to an existing structure comprising:

an elongated bridge member including means for connecting one of the ends of the bridge member to said existing structure; and at least one support tower mounted beneath said bridge member, said support tower including a caisson with a jacking member, having upper and lower portions telescopically mounted therein at the upper end of the caisson, said jacking member having its upper portion connected to the bridge member and its lower portion secured within a sleeve disposed within the caisson, a jacking means associated with said caisson adapted for extending the jacking member outwardly from said caisson, a portion of said jacking member being engaged by said jacking means, and means for anchoring the lower end of said support tower to a surface underlying said body of water, said means for anchoring being fixedly secured to the lower end of said support tower whereby relative motion between the support tower and the surface underlying said body of water is prevented.

19. The structure of claim 18 wherein said anchoring means comprises an anchoring skirt, having a larger cross sectional area than said caisson, fixedly secured to the lower end of said caisson, and a plurality of pile sleeves mounted upon the lower end of the support tower and extending through said anchoring skirt.

20. The structure of claim 18 wherein a gas flare line is disposed upon said bridge member and a gas flare tip is attached to said gas flare line.

21. The structure of claim 18 wherein said bridge member includes means for installing a gas flare line.

22. The structure of claim 21 wherein said means for installing comprises a plurality of rollers disposed upon said bridge member.

23. The structure of claim 18 wherein the lower portion of said member is secured within the sleeve by grouting.

24. A method for erecting a bridge structure above a body of water comprising the steps of:

transporting a prefabricated bridge structure to a location adjacent an existing structure, said prefabricated bridge structure including an elongated support tower pivotably mounted upon said bridge member;

pivoting said support tower until it is in a spaced relationship with respect to a surface underlying said body of water;

connecting one end of said bridge member to said existing structure while the support tower is still in a spaced relationship with respect to the surface underlying said body of water;

extending the support tower until it is in contact with the surface underlying said body of water; and anchoring the support tower to the surface underlying said body of water.

25. The method of claim 24 wherein the support tower is anchored to the surface underlying said body of water by driving piles into said surface and securing the support tower to said piles.

26. The method of claim 25 which further includes the step of extending the support tower until the bridge structure is at least substantially parallel with a plane formed by the upper surface of the existing structure.

27. The method of claim 26 wherein the support tower is further extended until the end of the bridge structure, which is connected to the existing structure, is disposed lower than the other end of the bridge structure.

28. The method of claim 26 wherein said support tower includes a caisson having a jacking member telescopically mounted therein at its upper end, and said jacking member is secured within said caisson after the bridge structure is at least substantially parallel with a plane formed by the upper surface of the existing structure.

29. The method of claim 28 wherein said jacking member is secured within said caisson by grouting.

30. The method of claim 24 wherein a gas flare line and gas flare tip are installed on said bridge structure.

31. The method of claim 24 wherein said bridge structure includes a prefabricated gas flare line and a gas flare tip attached to said gas flare line after the support tower is anchored to the surface underlying said body of water.

32. The method of claim 24 wherein said support tower is pivoted by flooding the interior of said support tower.

* * * * *